United States Patent [19]

Eivola

[11] Patent Number: 5,044,095

[45] Date of Patent: Sep. 3, 1991

[54] METHOD AND APPARATUS FOR VENTILATION IN A MULTI-CYLINDER DRYER OF A PAPER MACHINE OR THE LIKE

[75] Inventor: Ilkka Eivola, Naantali, Finland

[73] Assignee: Valmet Paper Machinery Inc., Finland

[21] Appl. No.: 499,896

[22] Filed: Mar. 27, 1990

[30] Foreign Application Priority Data

Mar. 29, 1989 [FI] Finland ..... 891499

[51] Int. Cl.[5] ..... F26B 13/30; F26B 13/04

[52] U.S. Cl. ..... 34/117; 34/115

[58] Field of Search ..... 34/115, 117, 114, 122, 34/123

[56] References Cited

U.S. PATENT DOCUMENTS 4,172,007 10/1979 Kankaanpaa ..... 34/117 X 4,881,327 11/1989 Hauser et al. ..... 34/117 X 3,7851,822 8/1973 Crist ..... 34/117 X

*Primary Examiner*—Henry A. Bennett

*Attorney, Agent, or Firm*—Steinberg & Raskin

[57] ABSTRACT

Method and apparatus for ventilating pockets in a twin-wire multi-cylinder dryer of a paper machine which comprises upper and lower lines of drying cylinders, an upper wire guided by surfaces of the upper cylinders and upper guide rolls and a lower wire guided by surfaces of the lower cylinders and lower guide rolls, and wherein the web runs between the upper and lower cylinders over an open draw, includes providing the guide rolls with perforated mantles for directing air flows from their interiors into the pockets, and providing blow boxes with nozzles for directing air flows into the pockets.

10 Claims, 6 Drawing Sheets

METHOD AND APPARATUS FOR VENTILATION IN A MULTI-CYLINDER DRYER OF A PAPER MACHINE OR THE LIKE

BACKGROUND OF THE INVENTION

This invention relates generally to the drying of webs and, more particularly, to methods and apparatus for use in multi-cylinder drying sections of paper machines or the like.

Specifically, the present invention relates to methods and apparatus for ventilating "pockets" in multi-cylinder dryers of paper machines which include two lines of drying cylinders and upper and lower drying wires guided by corresponding upper and lower guide rolls. The paper web is passed over short open draws from cylinders in one line to cylinders in the other.

The running speeds of paper machines have been steadily increasing and presently are approaching speeds of up to about 1500 meters per minute. At such high speeds, fluttering of the web becomes a serious problem hampering the running quality of the paper machine. Although the transfer of the web from the paper machine press section to the drying section, and its subsequent support in areas of single-wire draws are able to be controlled by conventional methods and apparatus, such as those disclosed in prior patents assigned to the assignee of the instant application, difficulties are still encountered at high running speeds in areas of twin-wire draws, such as in the third and fourth drive groups of drying apparatus.

As used herein, the term "single-wire draw" means a conventional arrangement for drawing a web over heated drying cylinders in which the web runs from one line ,of cylinders to the other while supported by a single drying wire. The web is situated between the drying wire and the cylinder surface as it travels over the cylinders of one of the lines. However, on the cylinders of the other line, the web is situated on the outer surface of the drying wire, i.e., the drying wire is situated between the surface of the cylinder and the web. Single-wire draws of this type are advantageous in that the web is supported at all times by the drying wire and has no open draw of any meaningful length, thereby reducing the risk of the formation of wrinkles in the web, as well as the possibility of web breakage.

As used herein, the term "twin-wire draw" refers to a conventional arrangement for supporting and drawing a web over heated drying cylinders in which upper and lower wires are guided by surfaces of the upper and lower cylinders respectively, as well as by upper and lower guide rolls situated in gaps between the upper and lower cylinders. The web is pressed by the upper wire into direct drying contact with the surfaces of the cylinders of the upper line, and, in a corresponding manner, the web is pressed by the lower wire directly against the surface of the cylinders of the lower line.

The web usually has substantially long open draws as it runs from one cylinder line to the other in twin-wire draw arrangements. The web is susceptible to fluttering or breakage as it travels over these open draws, and this problem has become more serious with increased running speeds of paper machines. The problem has become especially serious in the initial part of the drying section where the web is still relatively moist and, therefore, of low strength, and where its elastic properties promote fluttering. Attempts have been made to overcome these problems by shortening the open draws of the web in the initial parts of the drying section by positioning the drying cylinder lines closer to each other, i.e. by situating the imaginary planes passing through the axes of the upper and lower cylinder lines closer to each other than what has been customary, or from that which would be optimal, for example, in view of drying efficiency.

Attempts have also been made to solve the problems created in the running quality in the drying section resulting from increased running speeds of the paper machine by converting the drying section to single-wire draws throughout. However, since single-wire draws have lower drying capacities in view of the fact that the web is carried on the outside of the drying wire as it travels around the lower cylinders, such a solution is generally not advisable except where necessary, for example, in the first and second drying groups of the drying section. Therefore, it is still desirable to operate the subsequent groups in a drying section with twin-wire draws which are, as noted above, preferable to single-wire draws when considered from the viewpoint of drying capacity.

Some conventional solutions for overcoming the problems of web fluttering and breakage over open draws are suggested in U.S. Pat. Nos. 3,751,822 and 3,753,298. These patents disclose drying sections of paper machines provided with twin-wire draws that have been modified by means of arranging the relative positions of the guide and drying cylinders such that the web is supported by a wire substantially at all times and does not have any substantial free or open draws. The ventilation of the spaces or "pockets" formed between the wires and the free or open sectors of the drying cylinders is desirable in such arrangements to reduce fluttering, wrinkles, and breakage of the web caused by air flows induced by the moving wires. In those arrangements disclosed in U.S. Pat. Nos. 3,751,822 and 3,753,298, such pocket ventilation is provided by means of holes or apertures provided in some of the guide rolls through which air is pumped into the pockets.

SUMMARY OF THE INVENTION

It is a main object of the present invention to provide new and improved methods and apparatus for ventilating the pockets in a twin-wire multi-cylinder drying section of a paper machine or the like.

Another object of the present invention is to provide new and improved methods and apparatus for use in twin-wire multi-cylinder drying sections of paper machines or the like having high running speeds greater than about 1000 meters per minutes in which air flows that are induced by the wires will not cause problems such as undue web fluttering, web wrinkles, uneven drying or web breakage.

Briefly, in accordance with the present invention, these and other objects are attained by providing an arrangement wherein replacement air flows are directed into the pockets through perforations in the cylinder mantles of the guide rolls, and wherein air is blown into the pockets through nozzles provided in blow boxes. Thus, the mantles of the guide rolls are provided with perforated areas through which air flows are directed into the pockets for the purpose of ventilation. Blow boxes are provided within the pockets having nozzles through which the air flows are directed into the pockets for ventilation. The ventilation of the pockets is greatly intensified utilizing methods and apparatus in accordance with the invention thereby improving the running quality. Moreover, the apparatus used in connection with the invention is of simpler construction than conventional arrangements. For example, the blow box used in accordance with the invention is simpler in construction than the blow box used in conventional twin-run solutions.

DESCRIPTION OF THE DRAWINGS

A more complete appreciation of the present invention and many of the attendant advantages thereof will readily understood by reference to the following detailed description when considered in connection with the accompanying drawings in which.

DESCRIPTION OF THE PREFERRED EMBODIMENTS

Figure 1A:
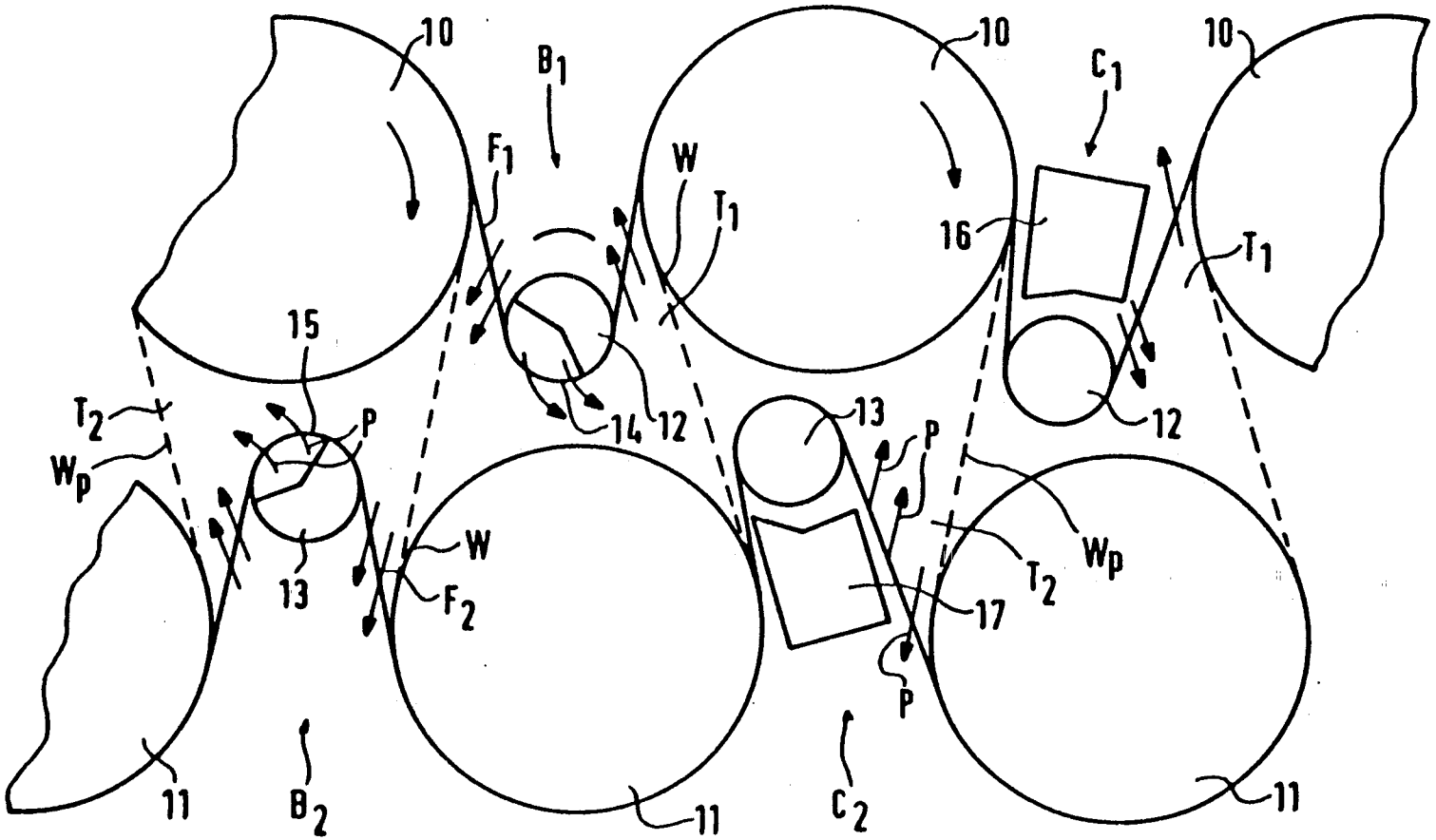
FIG.1A PRIOR ART
FIG. 1A is a schematic partial view of a conventional multi-cylinder twin-wire drying group of a paper machine in which two different draw arrangements are provided for the respective wires.

Referring now to the drawings where like reference characters designate identical or corresponding parts throughout the several views, and initially to FIG. 1A thereof, a multi-cylinder twin-wire drying group is shown in which two different conventional arrangements for ventilating the pockets are illustrated. The drying section comprises an upper line of drying cylinders 10, a lower line of drying cylinders 11, an upper wire $F_1$ guided by the surfaces of the upper cylinders 10 and upper guide rolls 12 situated between cylinders 10, and a lower wire $F_2$ guided by the surfaces of the lower cylinders 11 and lower guide rolls 13 situated between them. Although the web is guided by one of the wires $F_1$, $F_2$ over a small part of its travel between upper and lower cylinders 10,11, the web has relatively long open draws $W_p$ as it travels between the cylinders of the upper and lower lines.

Two different conventional techniques, designated B and C, for ventilating the pocket $T_1$ and $T_2$ are illustrated. According to arrangement $B_1$ for ventilating one of the pockets $T_1$ formed by the free or open sector of one of the lower cylinders 11, the upper wire $F_1$, and the open draws $W_p$ comprises providing the mantle of a guide roll 12 with a perforated surface 14 through which air flows P are directed into the pocket $T_1$. A similar arrangement $B_2$ is provided for ventilating one of the pockets $T_2$ formed by the open sector of an upper drying cylinder 10, the lower wire $F_2$, and the open draws $W_p$ of the web. In particular, the mantle of guide roll 13 is provided with perforations 15 through which air flows P are directed into the pocket $T_2$.

In the conventional arrangement $C_1$ for ventilating the other pocket $T_1$ formed between the open sector of drying cylinder 11, upper wire $F_1$ and the open draws $W_p$ of the web, the guide roll 12 is not provided with a perforated mantle, but functions solely as a guide roll. Ventilation of pocket $T_1$ is accomplished by means of a blow box 16 situated outside of pocket $T_1$ that produces air flows P that are directed through the wire $F_1$. A similar arrangement $C_2$ is provided for ventilating the other pocket $T_2$ by means of a blow box 17 situated outside pocket $T_2$.

The ventilation of the pockets $T_1$, $T_2$ in accordance with the arrangements $B_1$ and $B_2$ wherein air flows P are directed through the perforated mantles 14,15 of guide rolls 12, 13 has the drawback that at high running speeds of the machine, an increase in the quantity of air pumped by the wires $F_1$, $F_2$ is increased to such a high level that the quantity of air directed into the pockets $T_1$, $T_2$ through the guide rolls 12,13 must be reduced to a great extent. The ventilation arrangements $C_1$, $C_2$ are typical arrangements used in conventional twin-wire cylinder arrangements. However, the ventilation of pockets $T_1$, $T_2$ achieved by this arrangement is relatively weak.

Figure 1:
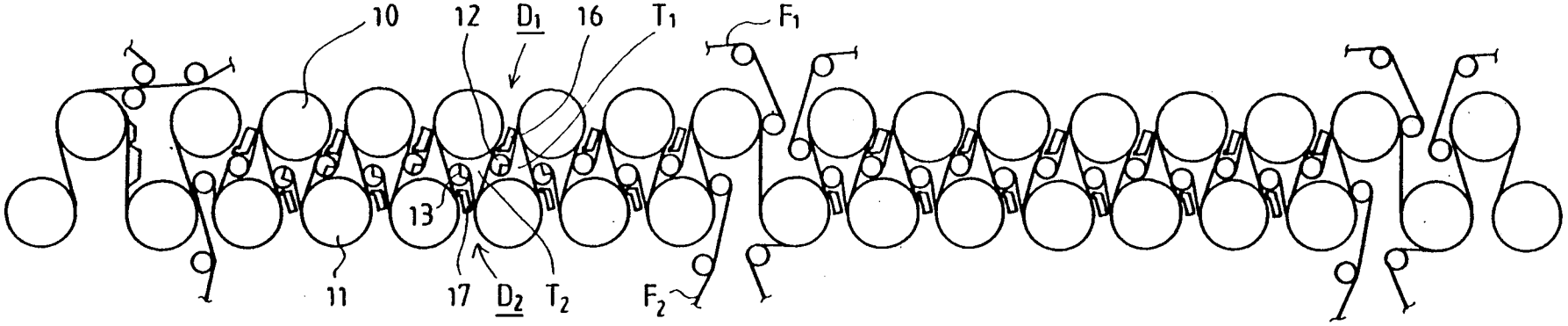
FIG. 1 is a schematic view of a twin-wire drying section of a paper machine provided with pocket ventilation in accordance with the invention.

Referring now to FIG. 1, a multi-cylinder twin-wire drying section of a paper machine is illustrated in which an upper wire $F_1$ is guided by upper cylinders 10 and upper guide rolls 12, while a lower wire $F_2$ runs over and is guided by lower cylinders 11 and lower guide rolls 13. Apparatus designated $D_1$ are provided for ventilating the pocket $T_1$ formed between the free sectors of the lower cylinders 11, the upper wire $F_1$, and the free draws of the web. Similarly, apparatus designated $D_2$ are provided for ventilating the pockets $T_2$ formed between the free sectors of upper cylinders 10, the lower wire $F_2$, and the free draws of the web. In accordance with the invention, the guide rolls 12, 13 comprise perforated rolls, i.e., have cylindrical mantles in which perforations are formed through which air flows are directed into the pockets, and at the same time, the air flows are directed into the pockets by means of blow boxes 16,17.

Figure 2:
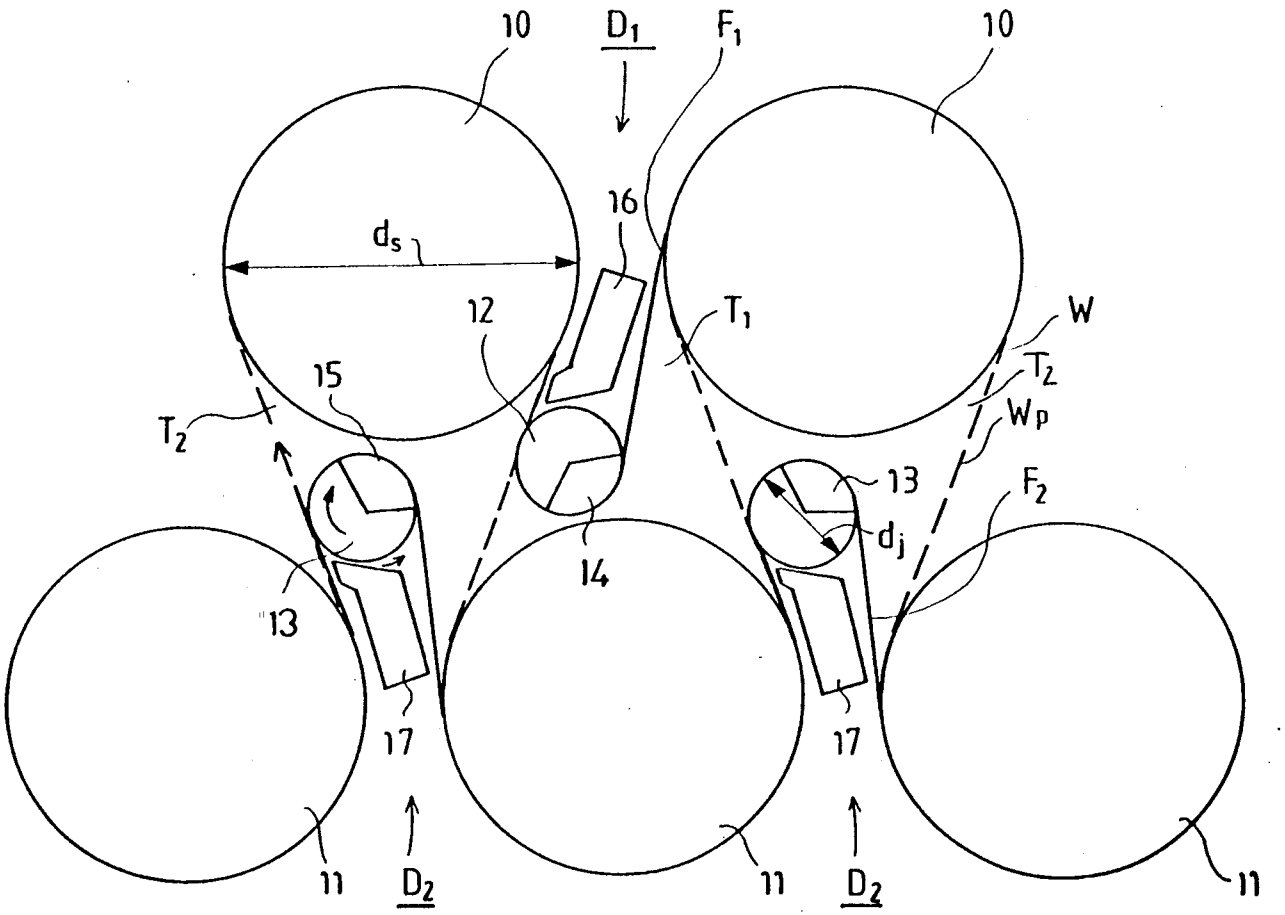
FIG. 2 is a schematic partial view of a twin-wire drying group of a paper machine drying section provided with a pocket ventilation arrangement for improving the running quality in accordance with the invention.

Reference is now made to FIG. 2 which illustrates a part of a drying group of a paper machine equipped with pocket ventilation apparatus, as well as for use in the twin-wire draw of the web. The apparatus $D_1$ for ventilating pocket $T_1$ comprise a perforated guide roll 12 and a blow box 16. Similarly, the apparatus $D_2$ for ventilating the pockets $T_2$ comprise the perforated guide rolls 13 and blow boxes 17. The diameter $d_s$ of a drying cylinder 10,11 is, for example, in the range of between about 1500 to 2000 mm., in which case the diameter $d_j$ of the guide rolls 12, 13 is in the range of between about 500 to 800 mm. Perforations are formed through the mantles over sectors 14,15 of the guide rolls 12,13. The sectors 14,15 essentially face respective pockets $T_1$ and $T_2$ and extend over angles in the range of between about 150° to 170°. The diameters of the perforations formed through sectors 14,15 vary in the range of between about 5 to 20 mm. The proportion of the percentage of the perforations in the area of the perforated sectors 14,15 is about 5%. The diameter $d_j$ of the guide rolls 12,13 is a function of the width, running speed and geometry of the paper machine in which a drying group of the type described is incorporated.

According to the invention, the ventilation of the pockets $T_1$ and $T_2$ is carried out by means of the perforated guide rolls 12,13 and by means of the blow boxes 16,17 as described below.

Figure 3:
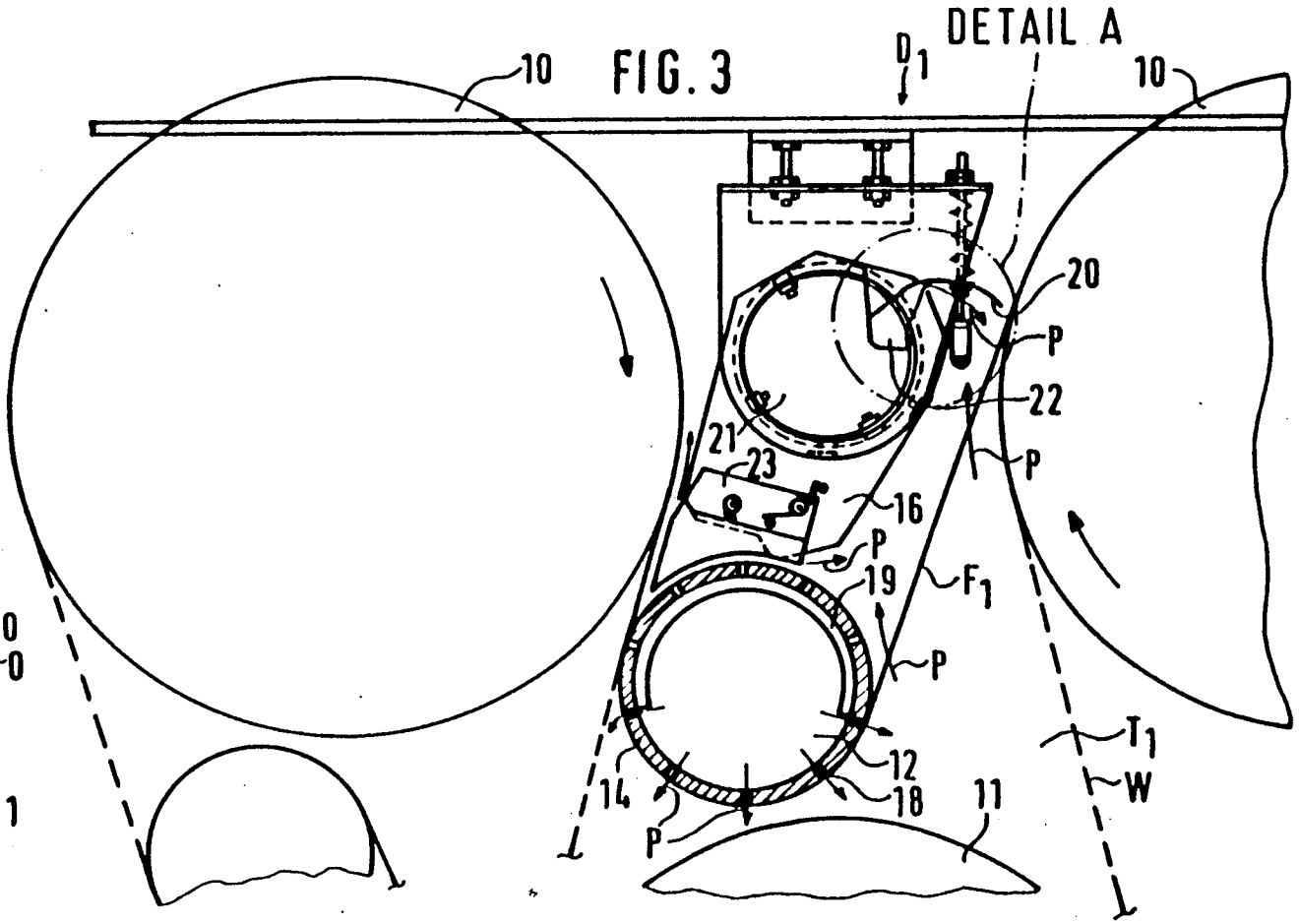
FIG. 3 is a schematic partial view of a twin-wire drying group in accordance with the invention having a blow box provided with a pivotable flow-directing nozzle plate for sectional regulation in accordance with the invention.

Referring now to FIG. 3, a more detailed illustration on an enlarged scale of the apparatus $D_1$ in accordance with the invention illustrated in FIG. 2 is illustrated. Apparatus $D_1$ functions to both ventilate the pocket $T_1$ and to guide the upper wire $F_1$ in the twin-wire draw of the drying group. Pocket $T_1$ is ventilated by means of a perforated guide roll 12 having perforations 18 formed through its outer mantle. A blocking plate 19 is provided within guide roll 12 which causes air flows P to be directed only into the pocket $T_1$ through the perforations 18 in the mantle 14 as they come into facing relationship with pocket $T_1$. Replacement air, i.e. hot, dry air is used for the air flows P which ventilate the pocket. Replacement air is taken from outside of the drying system, and therefore, does not contain any moisture that has been released from drying the paper web W.

Figure 3A:
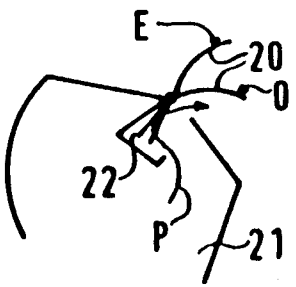
FIG. 3A is a view of detail A of FIG. 3, on an enlarged scale.

Still referring to FIG. 3 in conjunction with FIG. 3A, the blow box 16 comprises a nozzle 22 which communicates with a circulation-air space or plenum 21 into which circulation air is supplied. The nozzle 22 comprises a blocking plate 20 which is attached to the tip of nozzle 22 and by means of which it is possible to achieve sectional regulation of the air flows P. When blocking plate 20 is opened, i.e., in the position designated 0 in FIG. 3A, air flows are directed from nozzle 22 in the direction of arrow P towards the space between the blow box 16 and the wire $F_1$. The direction of the air flow P from nozzle 22 is substantially opposite to the direction of run of the wire $F_1$. When in the position E shown in FIG. 3A, the blocking plate 20 closes nozzle 22 and therefore precludes the access of air into the space between the blow box 16 and the wire $F_1$. Blow box 16 and guide roll 12 are coupled to the frame of the drying section of the paper machine by conventional means. The circulation air that is directed through nozzle 22 comprises the air that circulates in the drying system, the moisture content of which increases as the drying operation progresses. In order to ensure that the moisture percentages do not become excessively high, so that the drying of the web does not progress, from time to time part of the circulation air is replaced by replacement air, which is dry, and frequently hot.

Figure 4:
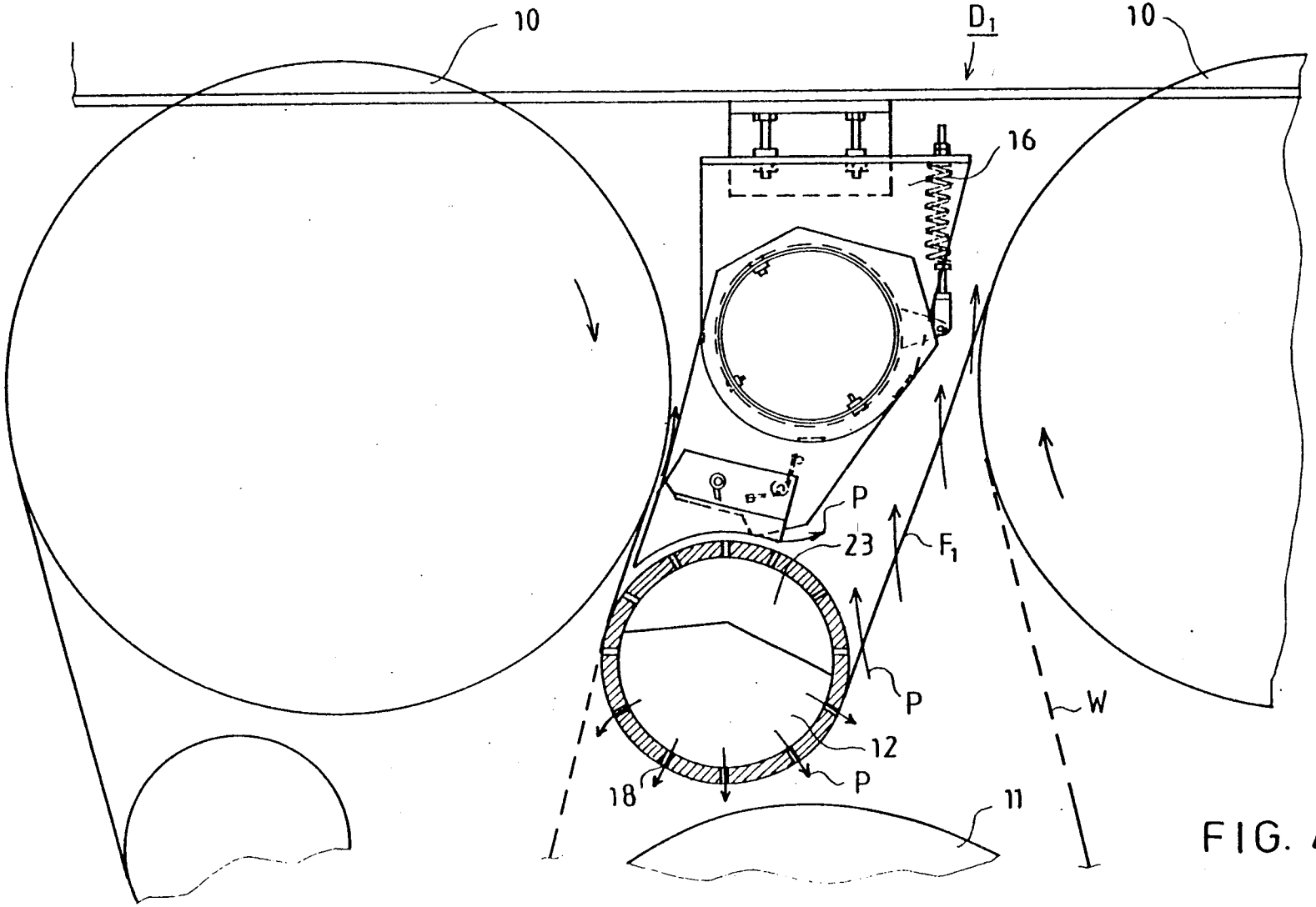
FIG. 4 is a schematic partial view of a twin-wire drying group in accordance with the invention in which a guide roll is provided with means for sectional regulation.

In the embodiment illustrated in FIG. 4, circulation air is directed from blow box 16 into the space between the blow box 16 and the wire $F_1$. Additional air flows P are also directed through the holes 18 of the guide roll 12. In this embodiment a blocking member 23 is provided within the guide roll 12 defining the sector of perforations 18 through which air is blown. In all other respects, the device is similar to that illustrated in FIGS. 1-3A.

Figure 5:
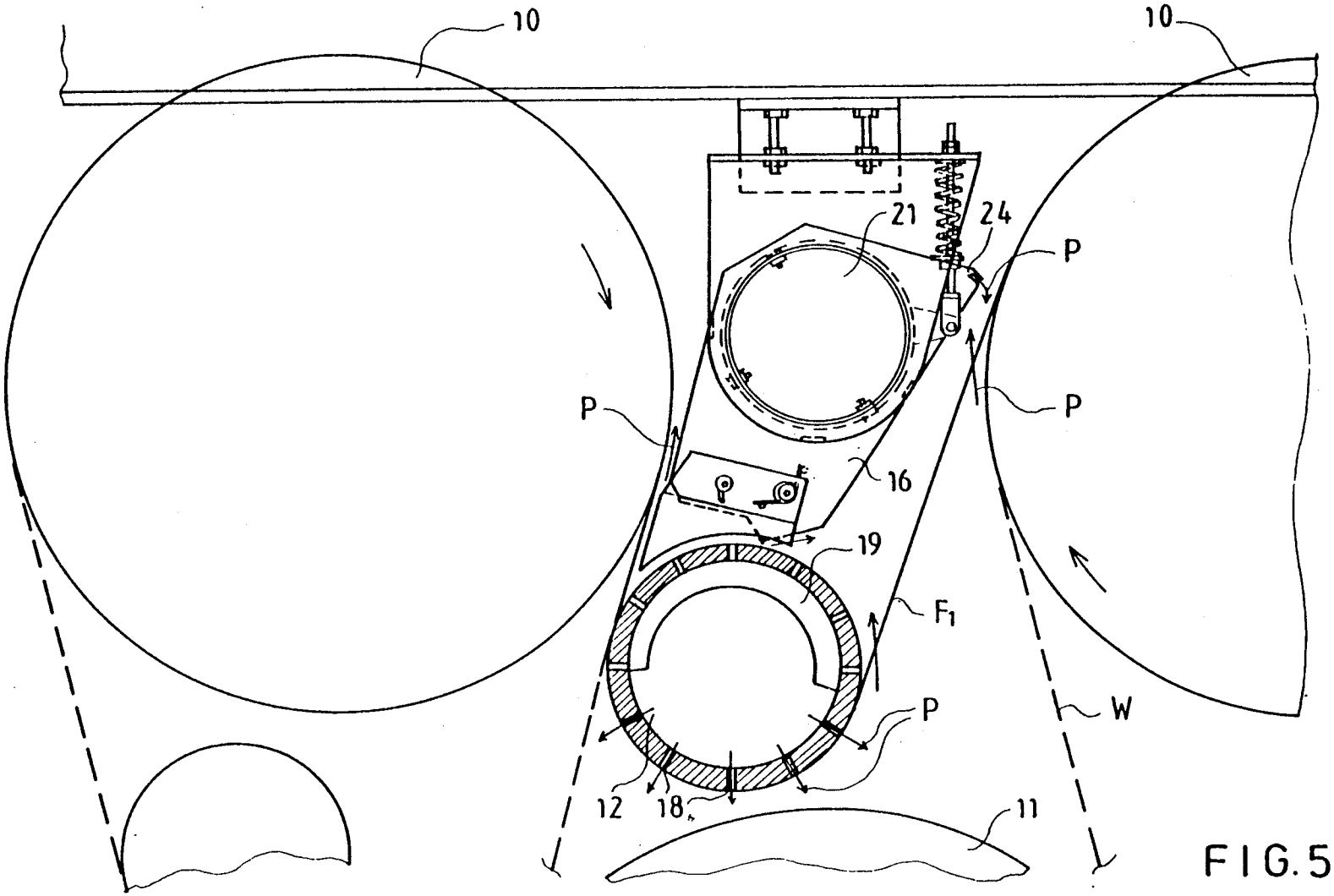
FIG. 5 is a schematic partial view of another embodiment of a twin-wire drying group in accordance with the invention.

In the embodiment of the invention illustrated in FIG. 5, the ventilation profile in the pocket can be regulated by means of a blocking nozzle 24 attached to the nozzle opening of the circulation-air space in the blow box 16. In other respects, the device illustrated in FIG. 5 is substantially similar to that shown in FIGS. 1-3*a*.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In a twin-wire multi-cylinder dryer of a paper machine comprising upper and lower lines of drying cylinders and upper and lower wires, wherein said upper wires are guided by surfaces of said upper cylinders and upper guide rolls situated between them, and said lower wires are guided by surfaces of lower cylinders and lower guide rolls situated between them, and wherein a web is pressed by said upper wire into direct drying contact with the surfaces of said upper cylinders and is pressed by said lower wire into direct drying contact with the surfaces of said lower cylinders, and wherein the web runs between said upper and lower cylinders over an open draw, the improvement comprising apparatus for ventilating pockets formed in the areas between said wires and surfaces of said cylinders, comprising:

said guide rolls being formed with perforations for directing air flows from their interiors into said pockets for ventilation of said pockets; and blow boxes having nozzles for ventilation of said pockets by means of air flows.

2. The improvement of claim 1 wherein said blow boxes each include a circulation air space and a blocking plate situated at a tip of said nozzle in said circulation air space for providing regulation of said pocket ventilation.

3. The improvement of claim 1 wherein said blow boxes each include blocking nozzle means for regulating a ventilation profile in a pocket.

4. The improvement of cl-aim 1 wherein said guide rolls further include means for blocking a sector of said perforations for regulating the pocket ventilation.

5. In a method in a twin-wire multi-cylinder dryer of a paper machine comprising upper and lower lines of drying cylinders and upper and lower wires, wherein said upper wire is guided by surfaces of said upper cylinders and upper guide rolls situated between them, and said lower wire is guided by surfaces of said lower cylinders and lower guide rolls situated between them, and wherein a web is pressed by said upper wire into direct drying contact with the surfaces of said upper cylinders and is pressed by said lower wire into direct drying contact with the surfaces of said lower cylinders; and wherein the web runs between said upper and lower cylinders over an open draw, a method for ventilating pockets formed in the areas between said wires and open surfaces of said cylinders, comprising the steps of:

directing air flows through perforations formed in cylinder mantles of said guide rolls into said pockets; and directing air flows through nozzles provided in said blow boxes into said pockets.

6. A method as recited in claim 5 included the additional step of blocking areas of said perforations of said guide roll mantles and directing air flow into said pockets through perforations provided in unblocked sectors of said cylinder mantles of said guide rolls.

7. A method as recited in claim 6 wherein said air flows directed through perforations in said cylinder mantles of said guide rolls comprises replacement air.

8. A method as recited in claim 5 wherein said blow boxes each include a circulation air space and said nozzles include blocking plates for providing sectional regulation, and wherein said air flows directed through said nozzles comprise circulation air.

9. A method as recited in claim 5 including the additional step of regulating the size of sectors of said perforated cylinder mantles of said guide rolls through which air flows are directed into said pockets.

10. A method as recited in claim 5 including the additional step of regulating the ventilation profile in said pockets by adjusting blocking means provided on said blow boxes.

* * * * *